US005398645A

United States Patent [19]

Haman

[11] Patent Number: 5,398,645

[45] Date of Patent: Mar. 21, 1995

[54] COMBUSTION CHAMBER FOR INTERNAL COMBUSTION ENGINE

[75] Inventor: David F. Haman, Waukegan, Ill.

[73] Assignee: Outboard Marine Corporation, Waukegan, Ill.

[21] Appl. No.: 77,007

[22] Filed: Jun. 15, 1993

[51] Int. Cl.[6] ..... F02P 13/00; F02F 3/24

[52] U.S. Cl. ..... 123/65 PD; 123/193.3

[58] Field of Search ..... 123/65 PD, 661, 193.3, 123/193.5, 193.6, 169 PH, 169 R, 169 CL, 169 PA, 257, 268, 657

[56] References Cited

U.S. PATENT DOCUMENTS

| | | | |
|---|---|---|---|
| 886,539 | 5/1908 | Peugeot et al. . | |
| 895,099 | 8/1908 | Moldon . | |
| 1,035,488 | 8/1912 | Stewart . | |
| 1,048,918 | 12/1912 | Van Vleck . | |
| 1,999,520 | 4/1935 | Stout . | |
| 2,227,247 | 12/1940 | Conover . | |
| 2,826,186 | 3/1958 | Fisher | 123/661 |
| 3,918,419 | 11/1975 | Dolza | 123/268 |
| 4,088,098 | 5/1978 | Rose et al. | 123/65 PD |
| 4,146,004 | 3/1979 | DuBois | 123/193.3 |
| 4,359,027 | 11/1982 | Scharpf | 123/193.3 |
| 4,367,707 | 1/1983 | Suzuki | 123/661 |

*Primary Examiner*—Andrew M. Dolinar
*Assistant Examiner*—M. Macy
*Attorney, Agent, or Firm*—Greer, Burns & Crain, Ltd.

[57] ABSTRACT

A combustion chamber for an internal combustion engine is provided which includes a cylinder head body having at least one generally dome-shaped combustion chamber defined by a lower surface of the body and having an intake side and an exhaust side, and a spark plug bore disposed in the combustion chamber so that when a spark plug is engaged in the bore, the dome-shaped portion is provided with an upper surface configured to shelter the electrode from direct impingement of a fresh charge introduced into the combustion chamber through the intake side.

12 Claims, 2 Drawing Sheets

COMBUSTION CHAMBER FOR INTERNAL COMBUSTION ENGINE

BACKGROUND OF THE INVENTION

The present invention relates generally to internal combustion engines, and specifically to a specialized configuration for a combustion chamber used on such an engine which is designed to minimize spark plug fouling.

Spark plug fouling can be caused when oil, gasoline, or mixtures of the two directly contact the spark plug electrodes to the extent that firing of the electrodes are interrupted or prevented entirely. The problem of fouling is a major design consideration in two-cycle engines, wherein the combustion charge is composed of a fuel-oil mixture, and where the electrodes are located in the cylinder in a position which is exposed to the flow of fresh charge or incompletely combusted fuel, oil and air.

The fouling problem is even more troublesome in small displacement two-cycle outboard marine engines of the type often used to power small boats. This latter class of engines is popular with recreational fishermen, who run their engines for prolonged periods of time at slow or idle speeds, during which the spark plug temperature does not reach the level where excess deposits of excess fuel/oil mixture can be burned off. This type of use exacerbates the spark plug fouling problem.

Small displacement two-cycle engines are often manufactured in the cross-flow format, wherein the fresh charge of gasoline, oil and air enters the cylinder through an intake port virtually simultaneously with the discharge of spent exhaust gases from an exhaust port. In these engines, the intake and exhaust ports are disposed in diametrically opposed locations of the cylinder. To prevent the mixing of fresh charge with the exhaust gases, and to reduce the passage of noncombusted fresh charge out the exhaust port prior to combustion, cross-flow engines are provided with a piston having a top-mounted deflector formation in the shape of a vane or baffle. This vane directs the fresh charge toward the spark plug electrodes, and prevents the fresh charge from passing through the exhaust port prior to combustion.

Cross-flow engines are quite suitable for outboard engines, in that the cross-flow design is particularly effective at "scavenging" the fresh charge gases at low rpm or at idle, when the volume of fresh charge in the combustion chamber is relatively small. This is because the movement of the piston in a two-cycle engine draws the fresh charge into the combustion chamber from the crankcase.

Another operational by-product of a two-cycle engine at idle is that the fresh fuel charge is not fully atomized by the action of the piston, connecting rod and crank shaft on the gas volume in the crankcase. Thus, when these relatively larger droplets of a fresh fuel charge are introduced into the combustion chamber, the potential for fouling increases.

It can be seen that the two-pronged problems of low spark plug temperature and incomplete atomization of the fresh charge in an idling two-cycle engine are significant contributors to the fouling problem. This problem is an especially acute one for sport fisherman, who depend on such small engines for transportation to and from the fishing grounds, and who are inconvenienced in a major way from engine fouling, especially when fouling occurs in remote locations or in foul weather.

One attempt at minimizing the spark plug fouling problem in two-cycle cross-flow engines is disclosed in commonly-assigned U.S. Pat. No. 4,146,004, wherein the cylinder head is provided with a generally V-shaped deflector extending towards the combustion chamber from the internal surface of the head. The deflector is intended to divert the incoming flow of fresh charge away from the spark plug electrodes, and to shield the electrodes from deposits of oil and/or gasoline, or from the impact of the combustion gas flow. Although this design reduced fouling over prior designs, the problem of engine fouling has not been eliminated.

Thus, a primary object of the present invention is to provide a combustion chamber shape for an internal combustion engine in which spark plug fouling is reduced significantly from conventional levels.

Another object of the present invention is to provide a cylinder head for a two-cycle cross-flow type engine having a combustion chamber shape in which the spark plug electrodes are protected from exposure to the direct flow of the fresh charge, but which still provides adequate power to the engine.

SUMMARY OF THE INVENTION

Accordingly, the above-identified objects are met or exceeded by the present internal combustion chamber, which is specially configured to shelter the spark plug electrode, and to deflect the fresh charge away from the electrode to prevent the impingement of fuel or oil upon the electrode and thus minimize fouling. The electrode is located in a specially designed cylinder head recess which places it out of the flow of the incoming fresh charge.

More specifically, the present invention includes a combustion chamber for an internal combustion engine, including a cylinder head having at least one generally dome-shaped combustion chamber portion defined by the lower surface of the cylinder head and having an intake side and an exhaust side. The cylinder head also includes a spark plug bore disposed in the dome-shaped portion so that when a spark plug having an electrode is engaged in the bore, the dome-shaped portion is provided with an upper surface configured to shelter the electrode from direct impingement of a fresh charge introduced into the combustion chamber through the intake side.

In the preferred embodiment, the present cylinder head is mounted upon a two-cycle cross-flow type engine, wherein the piston has a top surface with a deflector formation for directing the fresh charge into the cylinder and minimizing the flow of fresh charge out to the exhaust. The present cylinder head combustion chamber portion is configured such that, in conjunction with the deflector formation on the top of the piston, it properly directs the flow of incoming charge to concentrate the fresh charge near the spark plug electrodes.

In another embodiment, the present invention provides a combustion chamber for combusting a fuel/air mixture for a cross flow two-cycle spark-ignited engine, the chamber including a side wall having an intake port through which an incoming charge of the fuel/air mixture enters the chamber, a reciprocating bottom wall opening and closing the intake port and having a fresh charge deflecting baffle for directing the charge from the intake port in a first direction, and a top wall having a fresh charge deflecting lip extending in a direction generally normal to the first direction located above the intake port, as well as a recess located substantially adjacent said lip and adapted to retain a spark plug having an electrode. The chamber is configured so that the spark plug electrode disposed in the recess is not in the direct path of the incoming fresh charge after deflection of the fresh charge in the first direction by the deflecting baffle and in the second direction by the top wall deflecting lip. Instead, the fresh charge flows past the electrode to prevent fouling.

DETAILED DESCRIPTION OF THE PREFERRED EMBODIMENT

Figure 1:
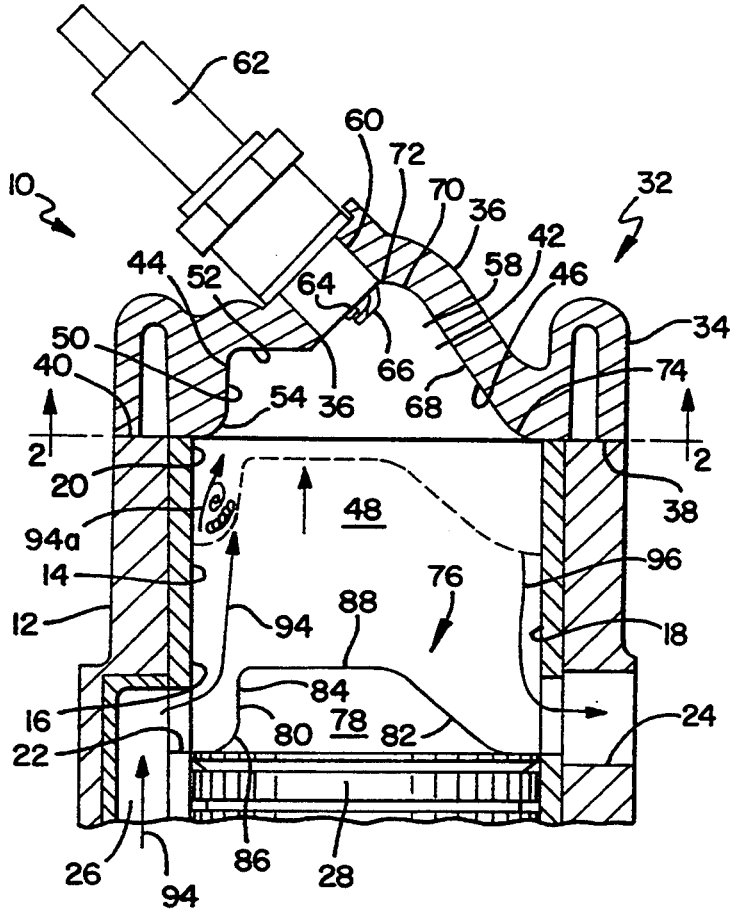
FIG. 1 is a fragmentary, partially sectioned, side elevational view of an internal combustion engine embodying the combustion chamber of the invention, with the piston shown in the intake/exhaust cycle position.
Figure 3:
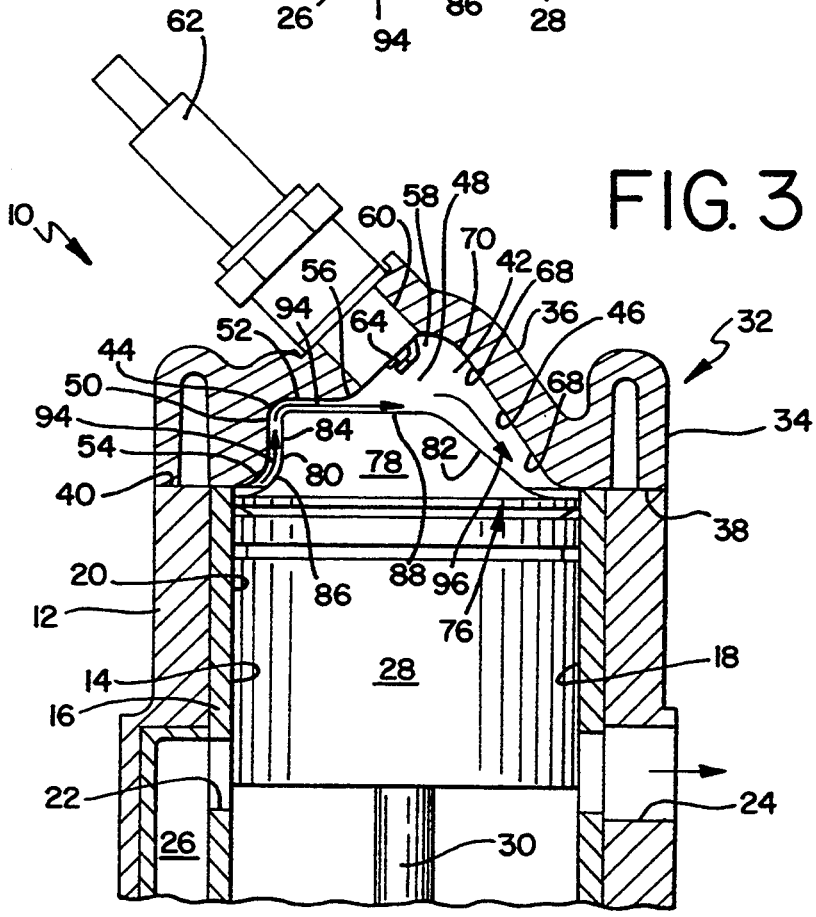
FIG. 3 is a fragmentary, partially sectioned, side elevational view of an internal combustion engine embodying the combustion chamber of the invention, with the piston shown in the compression/ignition cycle position.

Referring to the drawings, an internal combustion engine is generally designated 10 and is depicted in fragmentary form in FIGS. 1 and 3. The engine 10 is preferably of the two-cycle cross-flow type, but it is contemplated that the concepts embodied in the present combustion chamber may also be employed in other types of internal combustion engines. An engine block 12 includes at least one, and preferably two or more cylinders 14.

Each cylinder 14 has an intake side 16 and an exhaust side 18, and a sidewall 20 provided with at least one intake port 22 on the intake side, and at least one exhaust port 24 on the exhaust side. A transfer passage 26 places the intake port 22 in fluid communication with the engine crankcase (not shown) from which the fresh charge of fuel/oil/air mixture is drawn.

Mounted for reciprocating vertical movement inside each of the cylinders 14 is a piston 28 (shown fragmentarily), which is connected in conventional fashion to a crankshaft (not shown) by a connecting rod 30 (best seen in FIG. 3) for movement between an intake/exhaust position (best seen in FIG. 1) and a compression/ignition position (best seen in FIG. 3).

The engine 10 also includes a cylinder head, generally designated 32 having body 34 with an upper surface 36 and a lower surface 38. In the preferred embodiment, the lower surface 38 is provided with a relatively planar configuration for secure mounting to an upper surface 40 of the engine block 12 by threaded fasteners (not shown) as is well known in the art. However, it is contemplated that the cylinder head 32 may also be integral with the engine block 12. At least one generally dome-shaped portion 42 is defined by the lower surface 38 and has an intake side 44 and an exhaust side 46. The intake and exhaust sides 44, 46 of the cylinder head 32 correspond to the intake and exhaust sides 16, 18 of the cylinder 14. An upper surface of the piston 28, the sidewall 20 of the cylinder 14, and the dome-shaped portion 42 of the cylinder head 32 combine to define a combustion chamber 48.

The intake side 44 of the cylinder head 32 is configured to receive the fresh combustion charge flowing in a first, generally vertical direction along the sidewall 20 of the cylinder 14 and to deflect the flow of that charge to a second, generally horizontal direction which is generally normal to the first direction. More specifically, as seen in FIGS. 1 and 3, the dome-shaped portion 42 on the intake side 44 is provided with a generally vertically oriented side wall 50, and a generally horizontally-oriented top wall or lip 52 abutting the side wall 50 at an approximate right angle. A lower portion 54 of the side wall 50 is radiused or flared to provide a smooth flow of charge from the cylinder side wall 20 into the dome-shaped portion 42. A spark plug wall 56 abuts the top wall 52 and is angled therefrom to define a recess 58 in the dome-shaped portion 42. In the preferred embodiment, the spark plug wall 56 is angled in the approximate range of from 110 degrees to 150 degrees from the top wall 52.

A threaded spark plug bore 60 is located in the spark plug wall 56 and places the upper surface 36 and the dome-shaped portion 42 in communication. A spark plug 62 having an electrode 64 and a ground bar 66 disposed in conventional arrangement is threaded into the spark plug bore 60. The spark plug bore 60 is approximately normal to the plane of the spark plug wall 56 and is disposed at an angle relative to the vertical axis of the cylinder 14 so that upon the installation of the spark plug 62, the electrode 64 also projects into the dome-shaped portion 42 at an angle. In addition, in the preferred embodiment, the spark plug bore 60 generally defines the dome-shaped portion 42 into the intake side 44 and the exhaust side 46.

Turning now to the exhaust side 46, in general, the exhaust side has a ramped portion 68 (as seen in cross-section) to direct spent gases out of the dome-shaped portion 42, and ultimately, from the combustion chamber 48. The ramped portion 68 of the exhaust side 46 extends from a point 70 adjacent the spark plug bore 60. A relatively short radiused portion 72 lies between the bore 60 and the ramped portion 68 of the exhaust side 46. A lower portion 74 of the ramped portion 68 is also radiused or flared to smoothly direct the flow of exhaust gases from the dome-shaped portion 42 into the cylinder 14.

The piston 28 is provided with a top surface, generally designated 76, which includes a deflector formation 78. In similar fashion to the dome-shaped portion 42, the deflector formation 78 includes an intake portion 80 generally shaped in a right angle to nest within the shape of said intake side, and an exhaust portion 82 configured with an inclined or ramped shape to generally nest within the ramped portion of the exhaust side 46.

Included in the intake portion 80 of the deflector formation 78 is a generally vertical wall 84 having a radiused or flared bottom portion 86, and a generally horizontal top surface 88 joined at an approximate right angle to the vertical wall 84. Exhaust portion 82 gradually slopes from the top surface 88.

Figure 2:
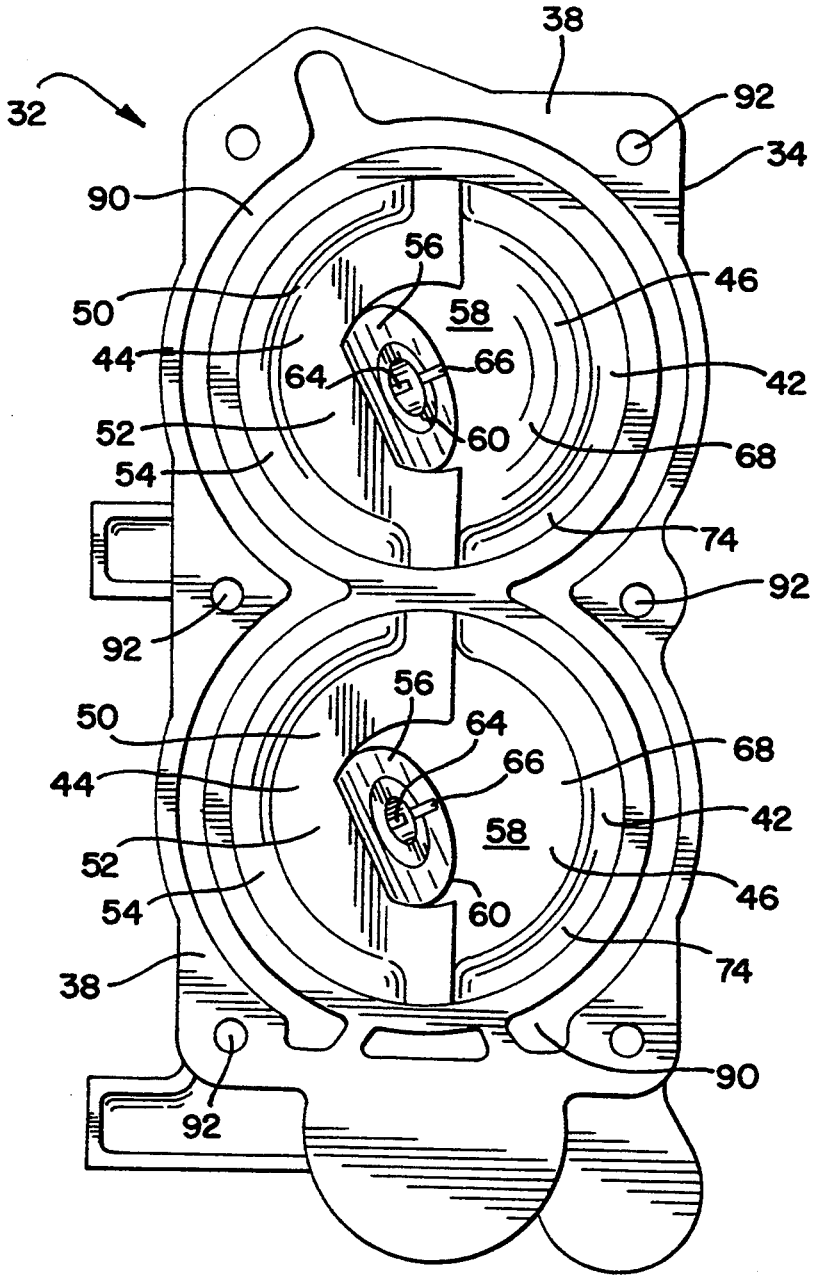
FIG. 2 is a bottom elevational view of the cylinder head depicted in FIGS. 1 and 2.

Referring now to FIG. 2, a plan view of the underside of the cylinder head 32 is illustrated, and it will be noted how the spark plug wall 56 generally defines the dome-shaped portion 42 into the intake side 44 and the exhaust side 46. It is also evident that the exhaust side 46 is generally spherical in shape. The dome-shaped portion 42 is surrounded by a water jacket or cooling gallery 90 as is known in the art. Spaced about the lower surface 38 of the cylinder head 32 are disposed a plurality of throughbores 92 to be used with threaded fasteners (not shown) in mounting the cylinder head upon the engine block 12, as is well known in the art.

Referring now to FIGS. 1 and 3, in operation, in a general sense, the fresh charge of fuel/oil and air is introduced from the crankcase, through the transfer passage 26, and into the combustion chamber 48 through one or more intake ports 22. The fresh charge, indicated by the arrows 94, is compressed during the upstroke or compression stroke of the piston 28 in the cylinder 14 (best seen in FIG. 1). As the piston 28 progresses vertically, the volume of the fresh charge 94 becomes compressed, as indicated at 94*a*. The charge 94 is ignited by the spark plug 62, preferably just prior to the piston reaching top dead center. During the subsequent downstroke or expansion stroke of the piston 28, the combustion products are exhausted from the combustion chamber 48 through one or more exhaust ports 24.

More specifically, a major advantage of the present invention is that, due to the configuration of the dome-shaped portion 42 of the cylinder head 32, the electrode 64 of the spark plug 62 will be sheltered from direct impingement of the fresh combustion charge introduced into the chamber 48 from the intake side 44. Referring to FIG. 3, the fresh charge 94 is compressed into the dome-shaped portion 42 during the upstroke of the piston 28.

During this compression, the fresh charge is forced along the generally vertical side wall 50 of the intake side 44, until it contacts the top wall or lip 52. Due to the compressed nature of the fresh charge, once it impacts the top wall 52, it is directed in a generally horizontal direction and travels past the spark plug electrode 64 at high velocity. The spark plug electrode 64 is located in the recess 58 so that while it is not directly exposed to the flow of the fresh charge, the atomized fresh charge will fill the recess for successful and complete combustion. Due to the generally horizontal flow of the fresh charge, the fuel/oil/air mixture passes by the spark plug electrode 64 without becoming impinged upon the electrode in a manner which will cause fouling. This is especially important when the engine is operated at idle, i.e., low operational and spark plug temperatures, and a reduced amount of available air.

Once the electrode 64 ignites the fresh charge, the exhaust gases, designated by the arrows 96, are directed down the ramped portion 68 of the exhaust side 46. Through the expansion caused by the ignition of the fresh charge, the exhaust gases are drawn down the side wall 20 of the cylinder 14 during the downstroke of the piston 28, until they reach the exhaust port 24 and exit therethrough.

It has been found that by placing the spark plug 62 in the recess 58, the electrode 64 is sheltered from the main flow of fresh charge, and is not in the direct path of the fresh charge. When similar displacement engines are compared, engines equipped with the present cylinder head 32 operate as much as three times longer without fouling than engines in which the spark plug is oriented directly in the flow of the fresh charge, as disclosed in commonly assigned U.S. Pat. No. 4,146,004, discussed above. Another advantage of the present cylinder head 32 is that when the piston 28 approaches top dead center, the generally horizontally oriented top wall 52 of the intake side 44 increases turbulence of the fresh charge gases, which also raises the temperature of the gas mixture near the electrode 64, thus increasing the propagation of the flame front generated by the spark plug. This effect also more completely burns the fuel and increases the engine's power and efficiency.

While a particular embodiment of the cylinder head for internal combustion engine of the invention has been shown and described, it will be appreciated by those skilled in the art that changes and modifications may be made thereto without departing from the invention in its broader aspects and as set forth in the following claims.

What is claimed is:

1. A cylinder head for an internal combustion engine, comprising:

at least one generally dome-shaped combustion chamber portion defined by a lower surface of said cylinder head, said dome-shaped portion having an intake side and an exhaust side;

said intake side being configured to receive the fresh charge flowing in a first direction and is also configured to deflect the charge to a second direction generally normal to said first direction;

said intake side being provided with a side wall, a top wall generally normal to said side wall for deflecting said charge, and a spark plug wall angled from said top wall to diverge from said second direction; and a spark plug bore disposed in said spark plug wall so that when a spark plug having an electrode is engaged in said bore, said spark plug wall shelters the electrode from direct impingement of a fresh charge introduced into said intake side of said dome-shaped portion and deflected in said second direction.

2. The cylinder head as defined in claim 1 wherein said spark plug wall is angled in the range of from 100 degrees to 160 degrees from said top wall.

3. The cylinder head as defined in claim 1 wherein said spark plug bore forms a general separation point in said dome-shaped portion between said intake side and said exhaust side.

4. The cylinder head as defined in claim 1 wherein said exhaust side is ramped to direct spent gases out of said dome-shaped portion.

5. The cylinder head as defined in claim 4 wherein the ramped configuration of said exhaust side extends from a point adjacent said spark plug bore in said dome-shaped portion.

6. An internal combustion engine configured for minimizing spark plug fouling and comprising:

an engine block having at least one cylinder, each said cylinder having an intake side and an exhaust side;

a piston disposed in each of said at least one cylinder for reciprocal movement, each said piston having a top surface with a deflector formation;

a cylinder head provided for each said cylinder and having an upper surface and a lower surface;

at least one generally dome-shaped combustion chamber portion defined by said lower surface of said cylinder head and having an intake side and an exhaust side;

said intake side of said dome-shaped portion having a top wall being configured to receive a fresh charge flowing in a first direction and to deflect the charge compressed by said piston to a second direction, said intake side also having a spark plug wall angled from said top wall to diverge from said second direction; and a spark plug bore disposed in said spark plug wall so that when a spark plug is engaged in said bore, an electrode of the spark plug will be sheltered from direct impingement of the compressed fresh charge deflected in said second direction.

7. The engine as defined in claim 6 wherein said deflector formation on said piston includes an intake portion generally angled to nest within the shape of said intake side of said dome-shaped portion, and an exhaust portion configured with a ramped shape to generally nest within said exhaust side of said dome-shaped portion.

8. The engine as defined in claim 7 wherein said deflector formation includes an intake side with a lower end having a radius, a top surface generally perpendicular to said intake side, and a generally inclined exhaust side.

9. The engine as defined in claim 7 wherein said engine is configured for two-cycle operation, with each cylinder having an intake port in said intake side, and an exhaust port in said exhaust side being substantially diametrically opposite said intake port, said deflector formation disposed on said piston to deflect incoming fresh charge into the combustion chamber, and to prevent the incoming charge from exiting directly out said exhaust port.

10. A combustion chamber for combusting a fuel/air mixture for a cross flow two-cycle spark-ignited engine, said chamber comprising:

a side wall having an intake port through which an incoming charge of the fuel/air mixture enters said chamber;

a reciprocating bottom wall opening and closing said intake port and having a fresh charge deflecting baffle for directing the charge from said intake port in a first direction;

a top wall having a fresh charge deflecting lip extending in a second direction generally normal to said first direction and above said intake port, and a spark plug wall located substantially adjacent said lip, said spark plug wall angled to diverge from said second direction and adapted to retain a spark plug having an electrode; and wherein the electrode disposed in said spark plug wall is not in the direct path of said incoming fresh charge after said charge has been deflected in said first direction by said deflecting baffle and compressed and deflected in said second direction by said top wall horizontal deflecting lip.

11. The chamber as defined in claim 10 wherein the engine includes at least one cylinder in which a corresponding piston reciprocates, said bottom wall of said chamber being a top surface of said piston, and said side wall of said chamber being a side wall of said cylinder.

12. The chamber as defined in claim 11 wherein said top wall of said chamber is defined by a generally dome-shaped portion of a cylinder head.

* * * * *